US005639087A

United States Patent [19]

Ogawa et al.

[11] Patent Number: 5,639,087

[45] Date of Patent: Jun. 17, 1997

[54] ROLLING GAME MACHINE

[75] Inventors: Akihisa Ogawa, Yokohama; Takashi Hamano, Kawasaki, both of Japan

[73] Assignee: Konami Co., Ltd., Hyogo-ken, Japan

[21] Appl. No.: 496,375

[22] Filed: Jun. 29, 1995

[51] Int. Cl.[6] ..... A63F 9/00

[52] U.S. Cl. ..... 273/109; 273/108; 273/118 R; 273/118 A; 273/126 R; 273/126 A

[58] Field of Search ..... 273/108, 109, 273/110, 118, 126

[56] References Cited

U.S. PATENT DOCUMENTS 5,066,014 11/1991 Dobson ..... 273/108 X
5,071,127 12/1991 Bromley et al. ..... 273/126 A
5,425,536 6/1995 Kelley et al. ..... 273/108 X
5,445,376 8/1995 Bromley ..... 273/108 X

*Primary Examiner*—Raleigh W. Chiu
*Attorney, Agent, or Firm*—Jordan and Hamburg

[57] ABSTRACT

A rolling game machine includes: a rolling unit by way of which the player rolls a rollable object in a desired direction; an interference member movable in a direction intersecting the inertial direction of the rolling object; an opposite detector arranged opposite the rolling unit for detecting a rollable object which has been rolled across the interference member; an end detector arranged near a forward end of the interference member for detecting a rollable object which has fallen and moved by the interference member; a rating device which assigns a rate to a rollable object which has completed its rolling on the basis of detection of the first and second detectors; and a ticket issuing device which issues a ticket corresponding to an assigned rate.

29 Claims, 14 Drawing Sheets

ROLLING GAME MACHINE

BACKGROUND OF THE INVENTION

This invention relates to a rolling game machine, particularly to a rolling game machine in which the player rolls a round object, such as a coin or a ball, over a moving surface in an attempt to obtain a higher score.

As a rolling game machine, U.S. Pat. No. 5,071,127 discloses a bowling game machine in which the player rolls a coin along one of several bowling lanes printed on a flat surface of a stationary platform toward rear positioned bowling pins to compete for higher scores. In this game machine, it is necessary to provide a sweeping member to remove coins which have fallen on the way to the target pins. This sweeping operation has impaired the amusement of the game.

Also, there has been known a game machine which is provided with a number of parallel-arranged moving endless belts. The number of parallel-arranged endless belts are allotted with different scores. The player tries to drop a coin or token onto a higher scored belt for competition. Accordingly, dropped coins or tokens are automatically recovered by the moving endless belts. However, this game machine cannot provide the thrilling feeling which the rolling game has.

SUMMARY OF THE INVENTION

It is an object of the present invention to provide a rolling game machine which has overcome the problems residing in the prior art.

It is another object of the present invention to provide a rolling game machine which can recover fallen objects automatically with a simple construction keeping the game amusing.

According to the present invention, a rolling game machine comprises: a rolling unit by way of which the player rolls a rollable object; and a forcible unit operable to give a force to the rolling object in a direction intersecting the inertial direction of the rolling object.

The forcible unit may be provided with an interference member movable in a direction intersecting the inertial direction of the rolling object.

It may be desirable to further provide an opposite detector arranged opposite the rolling unit for detecting a rollable object which has been rolled across the interference member. Further, an end detector may be additionally arranged near a forward end of the interference member for detecting a rollable object which has fallen and moved by the interference member. Moreover, it may be preferable to further provide an opposite reception pocket opposite the rolling unit for receiving a rollable object which has rolled across the interference member, the opposite reception pocket carrying the opposite detector, and provide an end reception pocket near the forward end of the interference member for receiving a rollable object which has fallen and moved by the interference member, the end reception pocket carrying the end detector.

Each of the opposite detector and the end detector may be provided with a photosensor having an optical path intersecting a passing path of a rollable object. The photosensor may be constructed by a first set comprising a light emitter and a light receiver facing each other; and a second set comprising a light emitter and a light receiver facing each other and arranged on a line perpendicularly intersecting a line along which the first set is arranged.

It may be desirable to additionally provide a rating device which assigns a rate to a rollable object which has completed its rolling on the basis of detection of the first and second detectors. Further, it may be desirable to provide a ticket issuing device which issues a ticket corresponding to an assigned rate. The rating device may be provided with a memory storing a relationship between the rates and the detectors.

The interference member may be constructed by a plurality of endless belts arranged in a direction perpendicular to the moving direction of the interference member. At least one of the plurality of endless belts may be moved in a direction opposite to the moving direction of the other endless belt. The plurality of endless belts may be attached to an interference object. Further, a bridging member may be provided between adjacent endless belts. The bridging member may be formed with a rising surface.

The rolling unit may be made to be pivotal about an axis intersecting a plane parallel with the interference member so that the player selectively determines a rolling direction.

With the thus constructed rolling game machine, a rollable object is rolled in a desired direction. The forcible unit gives a force to the rolling object in a direction intersecting the inertial direction of the rolling object. This will assure a greater thrilling feeling.

The forcible unit is provided with an interference member movable in a direction intersecting the inertial direction of the rolling object. A fallen object is moved out by the interference member. Accordingly, a special sweeping member is not required.

The opposite and end detectors are provided on peripheries of the interference member. Further, the rating device is provided. Accordingly, rating or evaluation for each rolling can be automatically accomplished.

The interference member is constructed by a plurality of endless belts arranged in a direction perpendicular to the first direction. Also, at least one of the plurality of endless belts is moved in a direction opposite to the first direction. Further, some interference objects are attached to each endless belt. These will increase the difficulty of rolling, thus enhancing the amusement.

Further, the rolling unit is made to be pivotal. This will give the player a wider selective range of rolling.

These and other objects, features and advantages of the present invention will become more apparent upon a reading of the following detailed description and drawings.

DETAILED DESCRIPTION OF THE PREFERRED EMBODIMENTS OF THE PRESENT INVENTION

Figure 1:
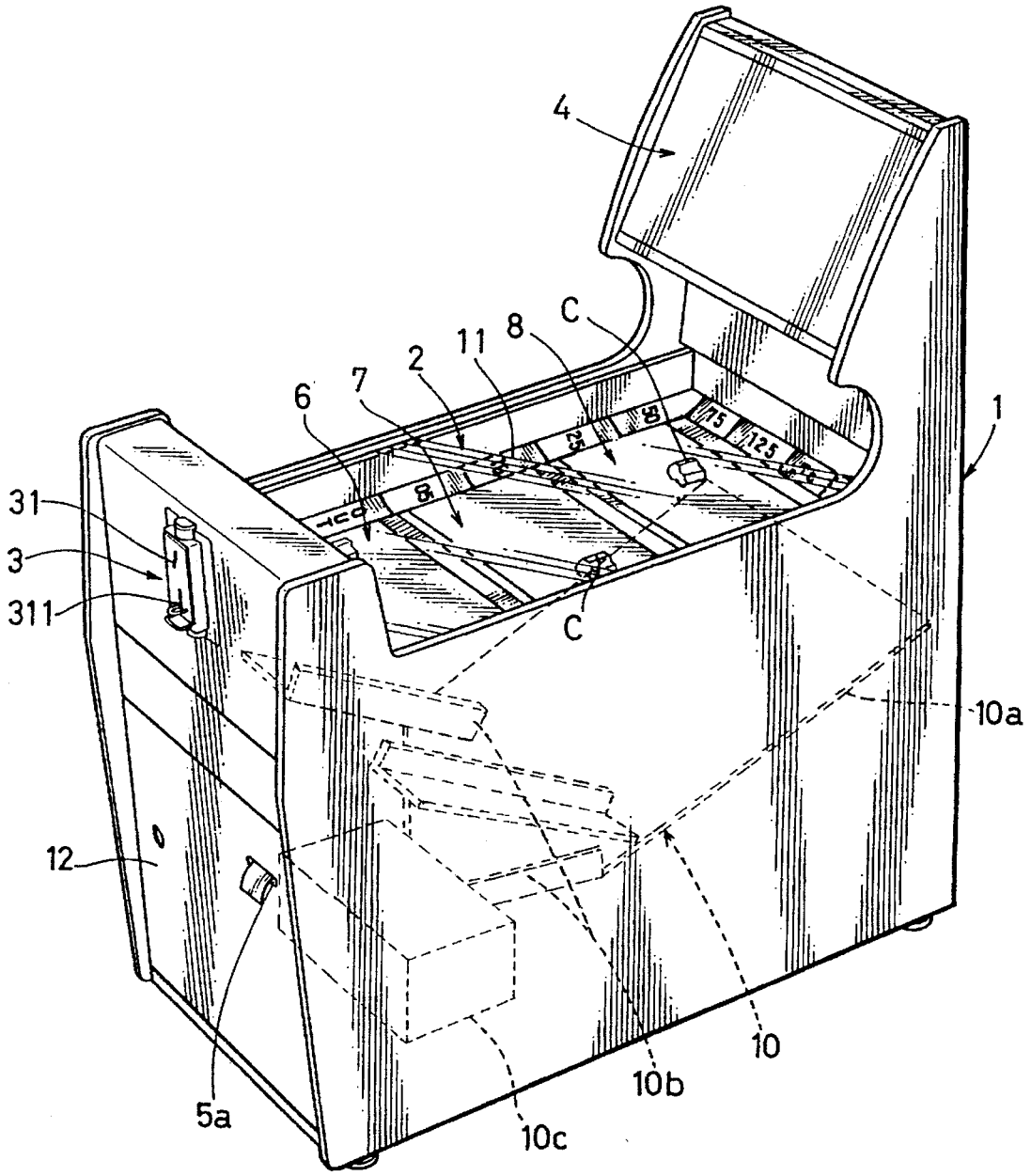
FIG. 1 is a perspective view showing an exterior of a rolling game machine embodying the present invention.

FIG. 1 is a perspective view showing an exterior of a rolling game machine embodying the present invention. The game machine includes a generally box-shaped housing 1, a playing portion 2 defined in a top of the housing 1, a coin chute unit 3 in a front of the housing 1, a prize ticket issuing device 5 below the coin chute unit 3 in the front, and a display portion 4 standing on a rear end of the housing 1. The display portion 4 is provided with characters or figures drawn on an outside surface thereof and a light therein for illuminating the characters or figures, thereby showing the content of this game to players. The playing portion 2 includes an interference zone having three sections 6, 7, and 8, a score indicating member 11 provided around the interference zone except a front end of the interference zone, and an array of coin reception pockets 9 below the score indicating member 11. In the interference zone, a rolling coin is given a falling force in a direction intersecting the internal direction thereof. The three interference sections 6 to 8 have a moving portion movable in widthwise directions of the housing 1. Also, there is provided a transparent cover la above the playing portion 2 to keep the player from touching the interference zone by hands. The transparent cover 1*a* is formed by a glass plate or acrylic resin plate.

In this rolling game machine, the player stands at the front of the housing, and inserts a coin into the coin chute unit 3 to roll the coin over moving interference sections 6 to 8. The more distant the coin rolls across interference sections 6 to 8, the higher score the player will gain. For example, if a coin successfully rolls across all three interference sections 6 to 8 and goes into a center pocket on the rear end, the player will gain the highest score. If a coin falls over the front interference section 6 and is moved away to a side pocket, the player will gain no score or a lowest score.

It should be noted that alternately the interference zone may be a single section or more sections than three. The more the number of interference sections, the more the number of score ratings which are possible.

First, a construction of the interference zone will be described in detail with reference to FIGS. 2 to 6. Each of the three interference sections 6 to 8 is constructed as one separable assembly unit. Each interference section is placed on a base supporting plate 1*b* which is horizontally arranged at an intermediate level in the housing 1. The base supporting plate 1*b* is supported by bracket members 1*c* secured on side walls of the housing 1.

The interference section 6 (7, 8) includes a base member 60 (70, 80), a drive roller portion 61*a* (71*a*, 81*a*), a driven roller portion 61*b* (71*b*, 81*b*), an endless belt 62 (72, 82), a motor 63 (73, 83), and support stand members 64 (74, 84) for supporting the drive and driven roller portions and the motor. The drive roller portion 61*a* (71*a*, 81*a*) and the driven roller portion 61*b* (71*b*, 81*b*) are spaced from each other a predetermined distance in a widthwise direction of the housing 1. The endless belt 62 (72, 82) is stretched between the drive roller portion 61*a* (71*a*, 81*a*) and the driven roller portion 61*b* (71*b*, 81*b*).

The three interference sections 6, 7, 8 have a substantially identical construction. Accordingly, the construction of the interference section 6 will be described as a general construction of the three interference sections 6 to 8. Different construction portions will be described according to need.

The drive roller portion 61*a* includes a shaft 611 extending in a depthwise direction of the housing 1, four rollers 612 fixedly mounted on the shaft 611 by a screw. The driven roller portion 61*b* has the same construction as the drive roller portion 61*a* except for the fact that the drive roller portion 61*a* is provided with the motor 63, a torque transmission mechanism, and a rotational speed sensor as described later.

The endless belt 62 is made by coating urethane resin over a strip of cloth. The endless belt 62 has the same width as the distance between both end rollers 612 on the shaft 611. The endless belt 62 is formed with an endless ridge 621 on an inner surface thereof. The endless ridge 621 is formed at a position corresponding to a gap between the intermediate rollers 612 on the shaft 611 when the belt 62 is mounted on the drive and driven roller portion 61*a* and 61*b*. Accordingly, the endless ridge 621 moves in the gap between the intermediate rollers 612 when the endless belt 62 is driven, consequently preventing the belt 62 from shifting in widthwise directions thereof.

Further, an outer surface of the endless belt 62 is imitatively painted with an automobile running road, and is fixedly attached with several miniature interference cars C at predetermined intervals in a lengthwise direction (rotating direction) and a width direction of the belt 62. These miniaturized cars C serves as interfering members as described below.

The car C is attached on the belt 62 as follows. A cord is connected to a bottom of the car C. The belt 62 is formed with holes. The cord connected to the car C is passed through the holes formed in the belt 62, and then tied to fasten the car C on the belt 62. Alternatively, the car C may be fixedly attached on the belt 62 by means of adhesives. The adhesive attachment does not cause projections on the inner surface of the belt 62 whereas the cord attachment results in cord tie-up portions, but the likelihood that the cord tie-up portion will interfere with a peripheral surface of the roller 612 will be eliminated.

The shaft 611 carrying the rollers 612 is rotatably supported at the both ends by the support stand members 64. Specifically, a bearing member 613 is fixedly placed in a hole 641 formed in an upper portion of each support stand member 64. The gearing member 613 is formed with a hole through which an end of the shaft 611 is passed.

Figure 5:
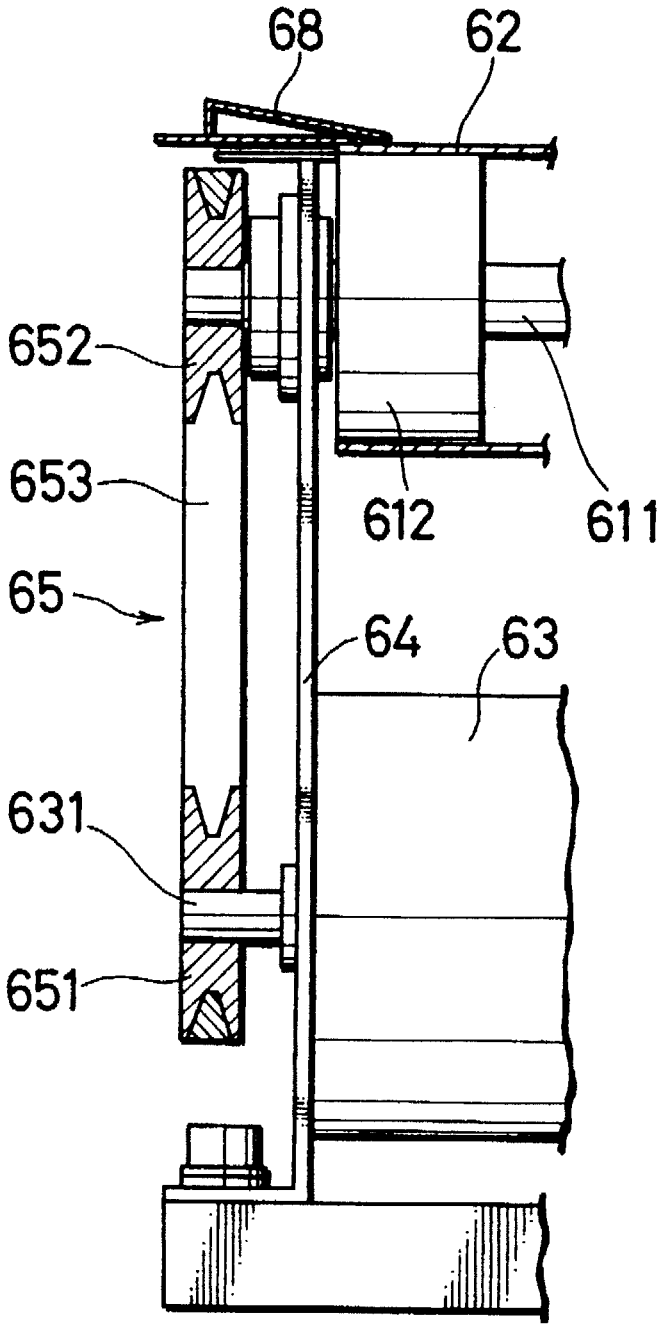
FIG. 5 is an enlarged sectional view showing another part of the playing portion.
Figure 6:
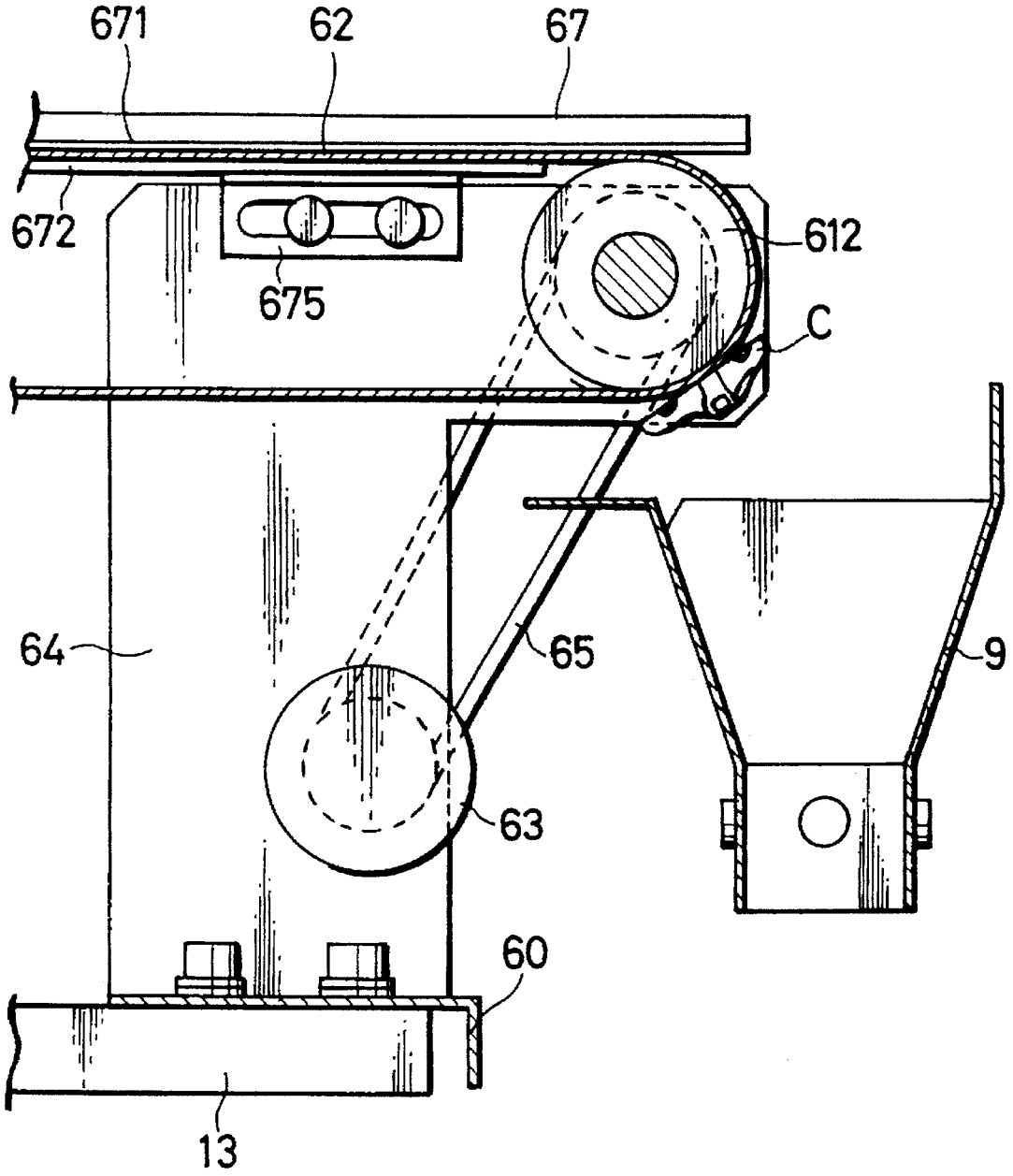
FIG. 6 is an enlarged sectional view showing the positional relationship between an interference endless belt of the playing portion and a coin recovery pocket.

One of the two support stand members 64 supporting the shaft 611 is attached with the motor 63 as shown in FIG. 5. The motor 63 is arranged inside of the support stand member 64. A torque transmission mechanism 65 is arranged outside of the support stand member 64. The torque transmission mechanism 65 includes a drive pulley 651 fixedly attached on a drive shaft 631 of the motor 63, a driven pulley 652 fixedly attached on the end of the shaft 611, and a V-belt 653 wound around the drive and driven pulleys 651, 652. In this way, the torque of the motor 63 is transmitted to the shaft 611 via the drive pulley 651, the V-belt 653, and the driven pulley 652.

Figure 3:
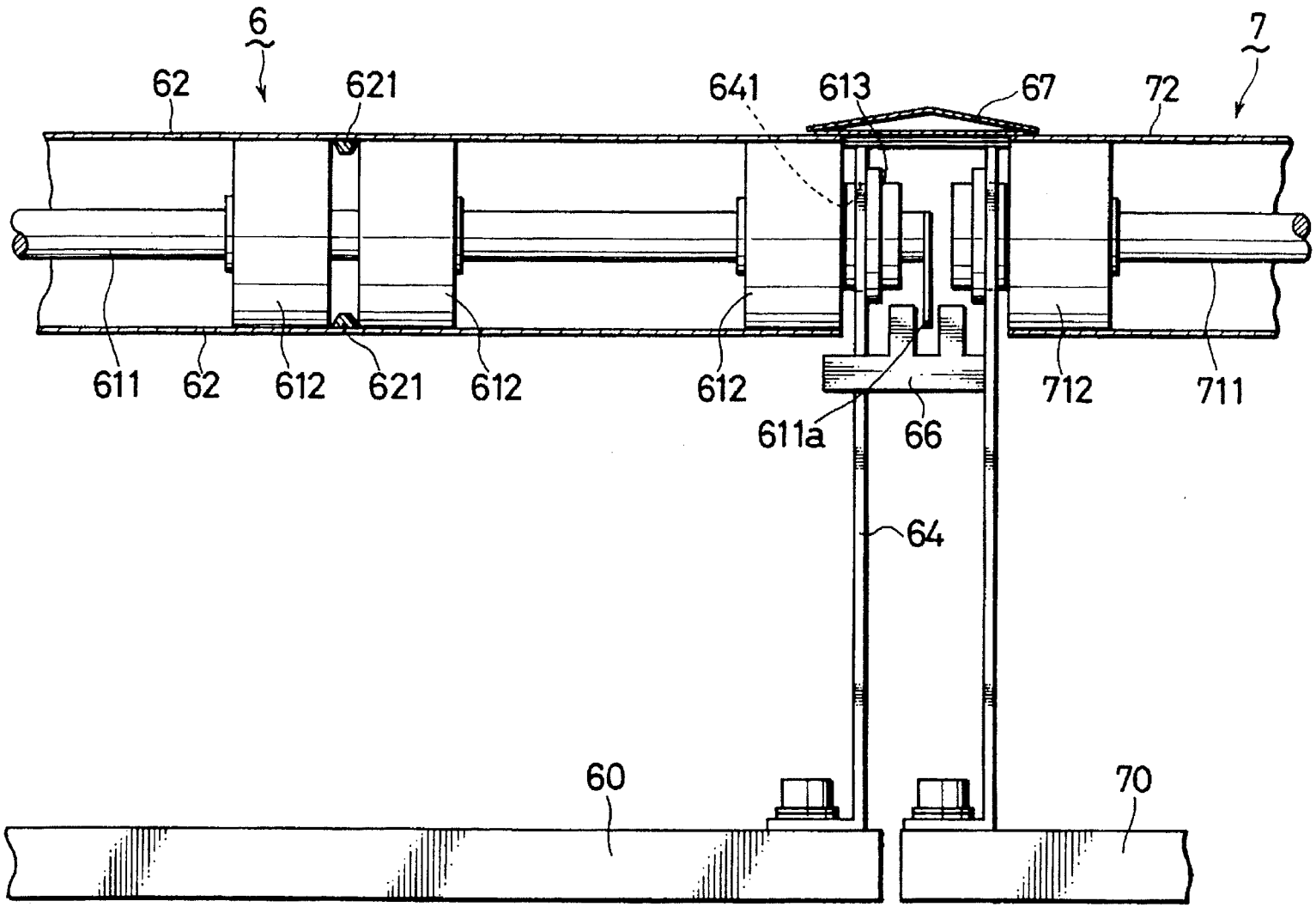
FIG. 3 is an enlarged sectional view showing a part of a playing portion of the rolling game machine.

On the other side of the shaft 611, as shown in FIG. 3, there is provided a photointerrupter type rotational speed sensor 66. Specifically, an interrupting plate 611*a* is attached on the end of the shaft 611 to revolve with the shaft 611. The sensor 66 has a light emitting portion and a light receiving portion. They are spaced from each other a predetermined distance in which the interrupting plate 611*a* passes with the rotation of the shaft 611. The sensor 66 counts the number of interruptions to detect the rotational speed of the shaft 611, that is, the moving speed of the endless belt 62. The thus detected rotational speed is used to control the motor 63 to stabilize the moving speed of the endless belt 62 as described later.

The endless belts 62, 72, 82 of the three interference sections 6, 7, 8 are basically moved at the same speed. However, the endless belts 62 and 82 of the end interference sections 6 and 8 are moved in an opposite direction to the endless belt 72 of the intermediate interference section 7.

Further, there is provided a bridging section 67 between the endless belts 62 and 72 and a bridging section 77 between the endless belts 72 and 82. Also, a leading section 68 is provided at a front end of the endless belt 62, and an ending section 87 at a rear end of the endless belt 82.

Figure 4:
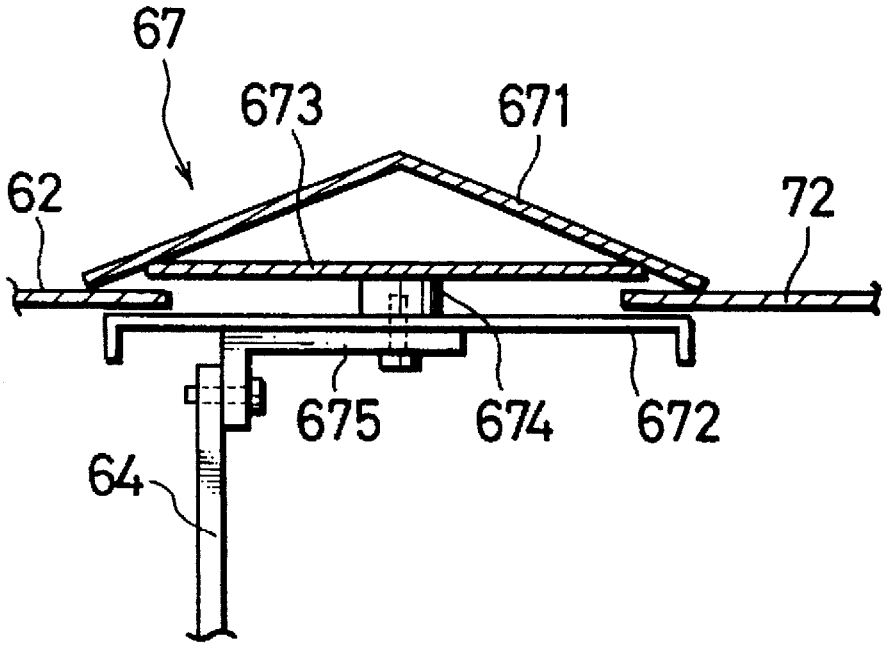
FIG. 4 is an enlarged sectional view showing a bridging section of the playing portion.

As shown in FIG. 4, the bridging section 67 is attached to the rear support stand member 64 of the drive roller portion 61*a* and the rear support stand member 64 of the driven roller portion 61*b*. The bridging section 67 has length substantially identical to the length of the upper run of the endless belt 62. The bridging section 67 includes a top member 671, a bottom member 672, an intermediate member 673 between the top and bottom members 671 and 672. The top member 671 and the bottom member 672 have a width larger than the gap between the endless belts 62 and 72. The top member 671 is bent at a predetermined inclusive angle along a center line thereof to form slope surfaces. The intermediate member 673 and the bottom member 672 are spaced from each other in a vertical direction slightly larger than the thickness of the endless belt so that a rear end of the endless belt 62 and a front end of the endless belt 72 can pass between the intermediate and bottom members 673 and 672. This space is held by a spacer 674 provided between the intermediate and bottom members 672 and 673. An upper surface of the bottom member 672 is on substantially the same level as a top periphery of the rollers 612 of the drive and driven roller portions 61*a* (61*b*). The three members 671 to 673 are integrally welded with one another. One section of an L-shaped bracket 675 is attached to the bottom member 672 by a screw while the other section of the L-shaped bracket 678 is attached to an upper end of the support stand member 64 by a screw. In this way, the bridging section 67 is attached to the support stand member 64.

The bridging section 67 provided between the endless belts 62 and 72 keeps a rolling coin from dropping into a gap between the endless belts 62 and 72.

Also, the top member 671 is formed with the sloping surfaces. Accordingly, even if a rolling coin falls on the bridging section 67, the coin slides down over either one of the sloping surfaces of the top member 671 to the endless belt 62 or the endless belt 72, and is then moved away from the falling position by either belt to assure restarting of the game.

It will be seen that if the top member is not formed with such sloping surfaces but is formed with a flat surface, a fallen coin is likely to stay on the bridging section 67.

It may be desirable to provide a top member having a single rising surface on a forward portion and a vertical surface on a rearward portion. The inclination of the sloping surface is set at such an angle as not to noticeably influence the rolling of coin and allow the fallen coin to slide down by its own weight.

The bridging section 77 has substantially the same construction as the bridging section 67. Accordingly, a detailed description of the bridging section 77 is omitted.

Also, the leading and ending sections 68 and 87 have substantially the same construction as the bridging section 67 for the top members. The top member of the leading section 68 has a single downward slope surface to allow an inserted coin to pass to the endless belt 62. On the other hand, the top member of the ending section 87 has a single upward slope surface.

Next, the coin chute unit 3 will be described with reference to FIGS. 1 and 2. The coin chute unit 3 is pivotally provided at an upper portion of the front wall of the housing 1. The coin chute unit 3 includes a casing 30, a coin insertion slot 31 formed in a front of the casing 30, a passage 32 formed in the casing 30 communicating with the slot 31, a chute guide 33 provided below the casing 30 for allowing an inserted coin to roll onto the endless belt 62 of the front interference section 6, and an upper and lower pivot stems 35, 36 on the front of the casing 30.

The coin chute unit 3 is placed in an opening formed at an upper portion of the front wall of the housing 1 by fitting the upper pivot stem 35 in an upper bracket 37 provided above the opening and the lower pivot stem 36 in a lower bracket 38 provided below the opening. Accordingly, the coin chute unit 3 is pivotably about the upper and lower pivot stems 35 and 36.

Also, a restriction member 39 is attached on an inner surface of the front wall of the housing 1. On the other hand, the casing 30 is attached with an arm 40 at the bottom thereof. The arm 40 is operable to come into contact with the restriction member 39 when the coin chute unit 3 rotates to a predetermined angle. In this way, the pivotal range of the coin chute unit 3 is limited by the combination of the restriction member 39 and the arm 40. The pivotal range is set in consideration of the length, width, and moving speed of the three belts 62, 72, and 82.

The player determines a most successful direction of the coin chute unit 3 considering the position of interference cars C and the moving speed of the interference endless belts, rotating the coin chute unit 3 into the determined direction, then inserting a coin into the slot 31*a* at a proper speed.

The chute guide 33 is formed with a groove in which an accepted coin rolls. The groove has a width slightly larger than a thickness of the coin and a depth slightly larger than the radius of the coin. The chute guide 33 is inclined at a predetermined angle to provide some rolling force to an accepted coin.

Further, a coin discriminator is provided in the passage 32 to keep unacceptable coins from coming in. Discrimination is done based on the diameter or thickness of an inserted coin. An unacceptable coin is returned to the player through a slot 311 formed in the front of the casing 30.

Further, a photosensor 34 is provided at a lower portion of the passage 32. The photosensor 34 is exposed to the passage 32 and detects the presence of a coin based on a light interruption or reflected light. Alternatively, the photosensor 34 may be provided in the chute guide 33. It may be desirable to use a magnetic sensor capable of detecting metal, a dielectric sensor capable of detecting a dielectric change, or a mechanical switch capable of turning on and off in accordance with contact with a coin, in place of the photosensor 34, to detect the presence of a coin.

Figure 7:
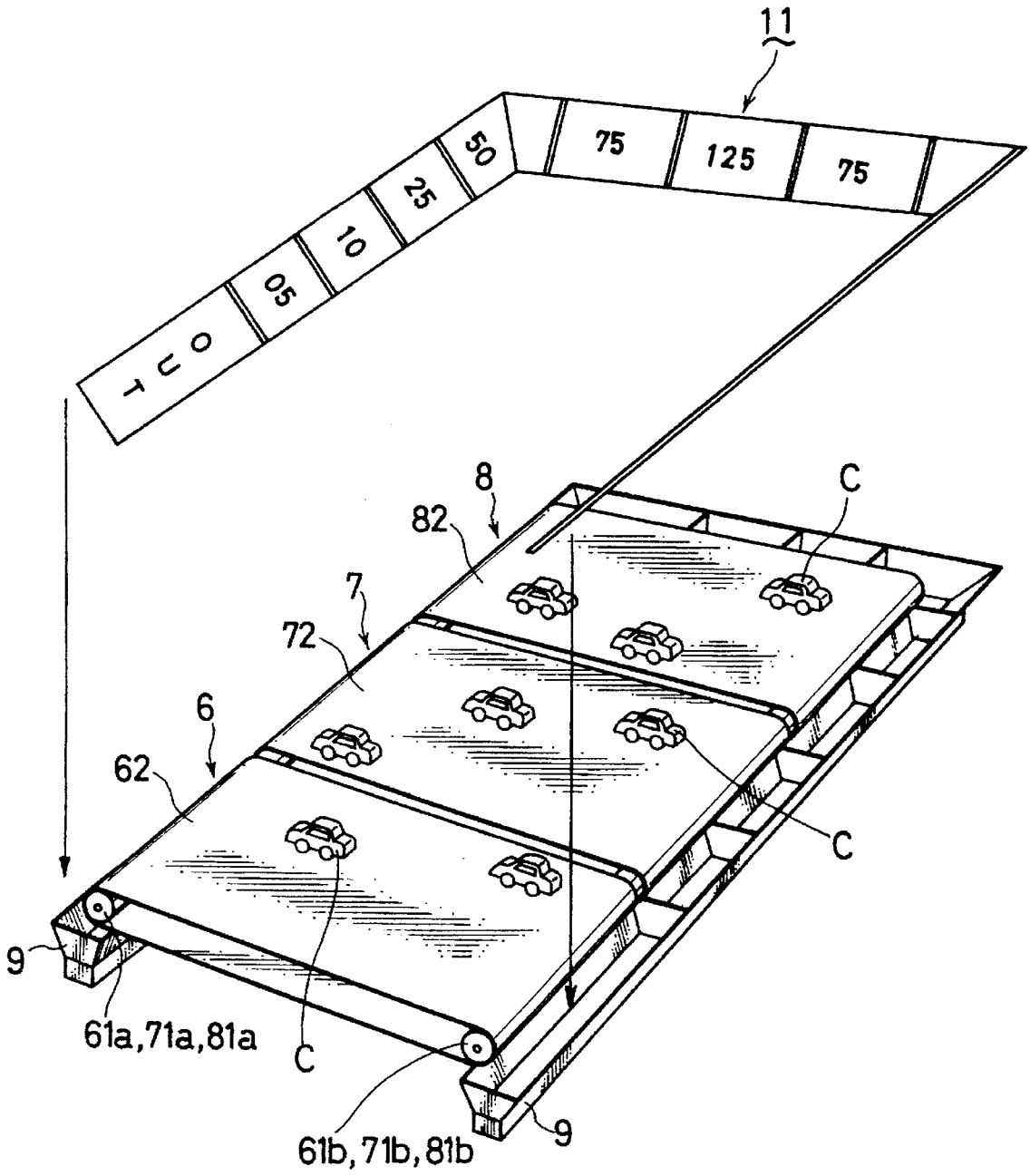
FIG. 7 is an exploded perspective view schematically showing a score indicating member and an interference zone of the playing portion.
Figure 8:
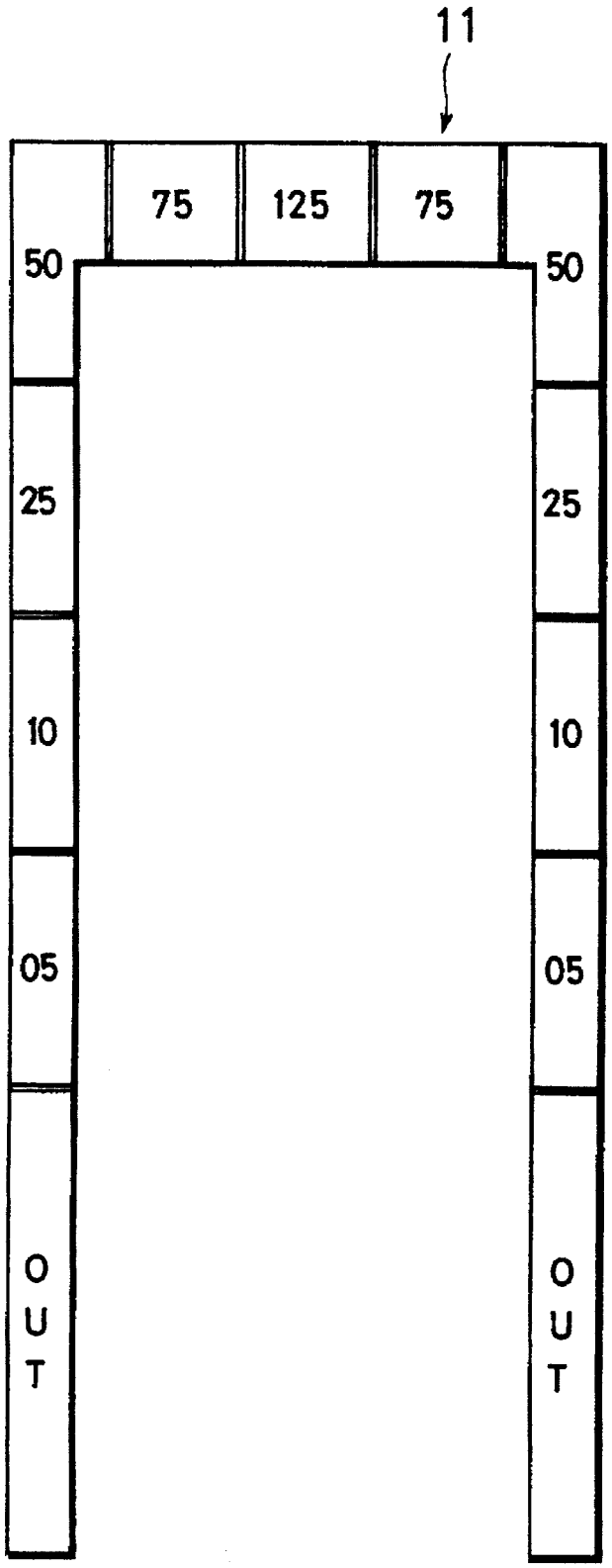
FIG. 8 is a top plan view of the score indicating member.

The score indicating member 11 has, as shown in FIGS. 7 and 8, right and left side portions and a rear portion. Each portion has a surface on which score numbers are provided. The score surface is inclined so that the player can easily see score numbers. The score indicating member 11 is mounted from above.

Score numbers are provided on the bases of difficulty of rolling in. Specifically, the right and left side portions each are divided into five sections. The five sections are given higher scores as the rear is approached, i.e., "OUT", "05", "10", "25", and "50". The rear portion is divided into three sections. The center section is given a highest score, i.e., "125", and right and left sections of the rear portion are given the same lower score, i.e., "75". Needless to say, score allotment is not limited to this, but may be changed as desired.

The array of coin reception pockets 9 is provided below the score indicating member 11, and the drive and driven roller portions 61*a* and 61*b* and the ending section 87. A coin reception pocket 9 is provided for each score section of the score indicating member 11. However, it should be noted that a coin reception pocket 9 is not required to be provided for each score section of the score indicating member 11, but a coin reception pocket 9 may be provided for two or more score sections of the score indicating member 11. The coin reception pocket 9 is spaced from the drive and driven roller portions 61*a* and 61*b* by a distance that the miniature cars C attached on the belts will not hit the coin reception pocket 9.

Figure 9:
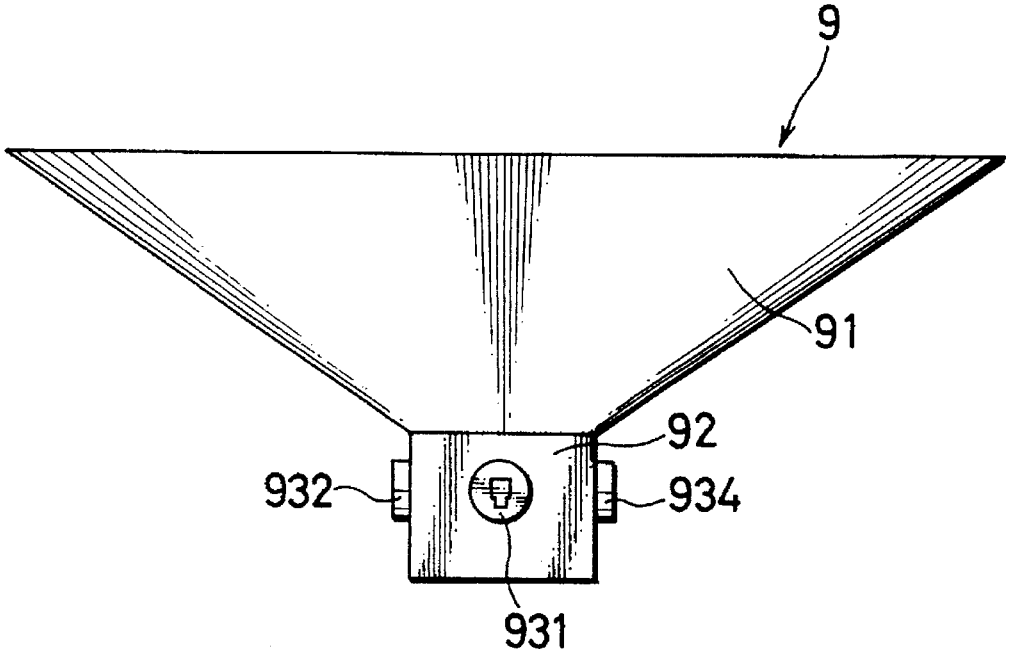
FIG. 9 is a front elevation view of the coin recovery pocket.
Figure 10:
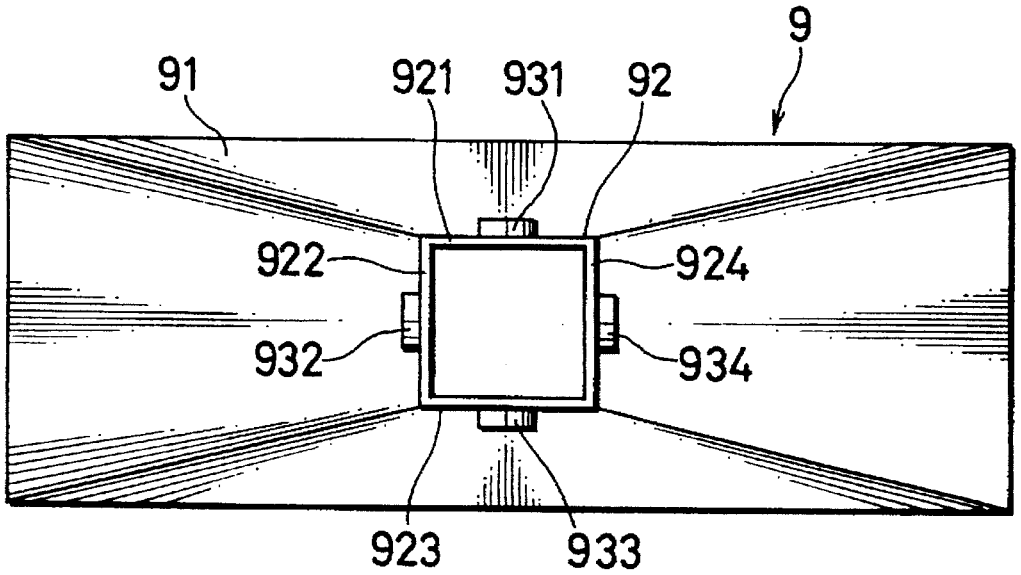
FIG. 10 is a bottom plan view of the coin recovery pocket.

A construction of coin reception pockets 9 will be described with reference to FIGS. 9 and 10. Each coin reception pocket 9 includes a reception portion 91 and a detection portion 92.

The reception portion 91 has four side walls defining a funnel. The width of the upper opening of the reception portion 91 is made to be the same for all the coin reception pockets 9. However, the length of the upper opening is made to be different according to corresponding scores. Accordingly, there are provided the same number of kinds of coin reception pockets 9 as the number of sorts of score provided on the score indicating member 11. FIGS. 9 and 10 shows one of the coin reception pockets provided in this game machine.

The detection portion 92 has four side walls 921 to 924 which defines a coin passage space having a square in a horizontal plane. The four side walls 921 to 924 are formed with holes at their respective centers on the same level.

A light emitter 931 and a light receiver 933 constituting a coin recovery sensor 93 are placed in the holes formed in the opposite side walls 921 and 923. The axis of the light emitter 931 is made to be in agreement with the axis of the light receiver 933. Similarly, a light emitter 932 and a light receiver 934 constituting another coin recovery sensor 93 are respectively placed in the holes formed in the opposite side walls 922 and 924.

When operational, the light receiver receives light which is emitted by the light emitter. When a coin passes the detection portion 92, the light receiver receives no light and consequently detects a presence or passing of the coin.

Figure 11A:
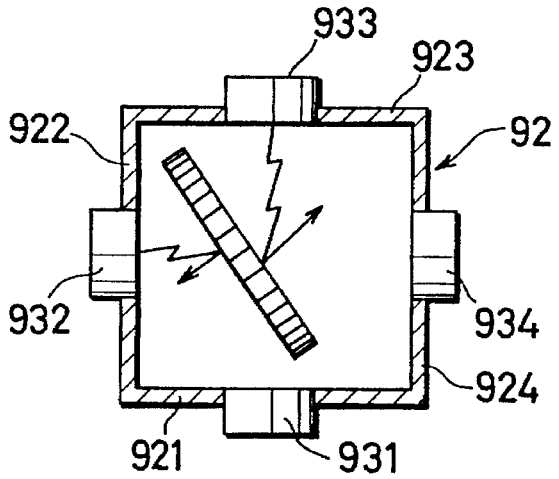
FIGS. 11A to 11C shows different postures of a coin passing through the coin recovery pocket, FIGS. 11A and 11C being a view in a horizontal section of the coin recovery pocket, and FIG. 11B being a view in a vertical section of the coin recovery pocket.
Figure 11B:
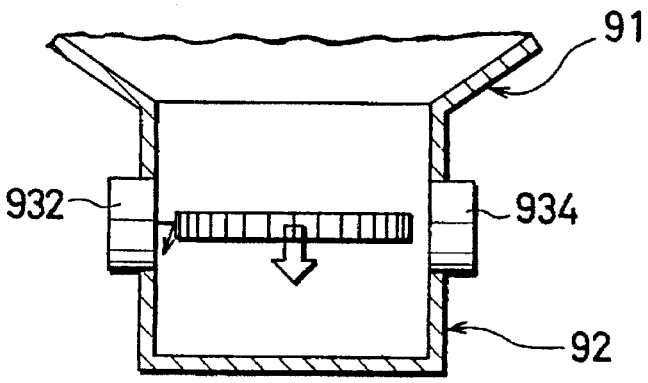
Figure 11C:
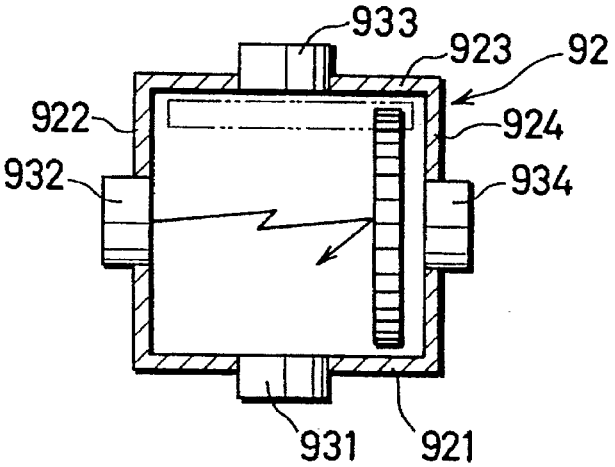

FIGS. 11A to 11C show detection of coins in different failing postures in more detail. FIGS. 11A and 11C are horizontal section views of a coin reception pocket 9, and FIG. 11B is a vertical section view of a coin reception pocket 9.

In the posture shown in FIG. 11A, the coin is detected by the two coin recovery sensors 93. In the posture shown in FIG. 11B, also, the coin is detected by the two coin recovery sensors 93. In the posture shown in FIG. 11C, the coin is detected by one of the two coin recovery sensors 93. Accordingly, it will be apparent that the provision of the two coin recovery sensors 93 on intersecting two lines can reliably detect a coin falling in any posture.

It should be noted that two coin recovery sensors are not required to be arranged in such a manner that they are on the same level and their optical paths intersect each other perpendicularly, but it may be sufficient to arrange two coin recovery sensors in such a manner that their optical paths intersect each other when seen from above.

Also, photoreflector type sensors may be used as coin recovery sensors in place of the photointerrupter type sensors 93 in the foregoing embodiment.

The coin passage defined by the four side walls 921 to 924 is made to be larger than the diameter of a coin to ensure free passing of the coin and to prevent coins from jamming the passage. It may be desirable to shape the detection portion into a circle or other forms instead of a square.

Figure 2:
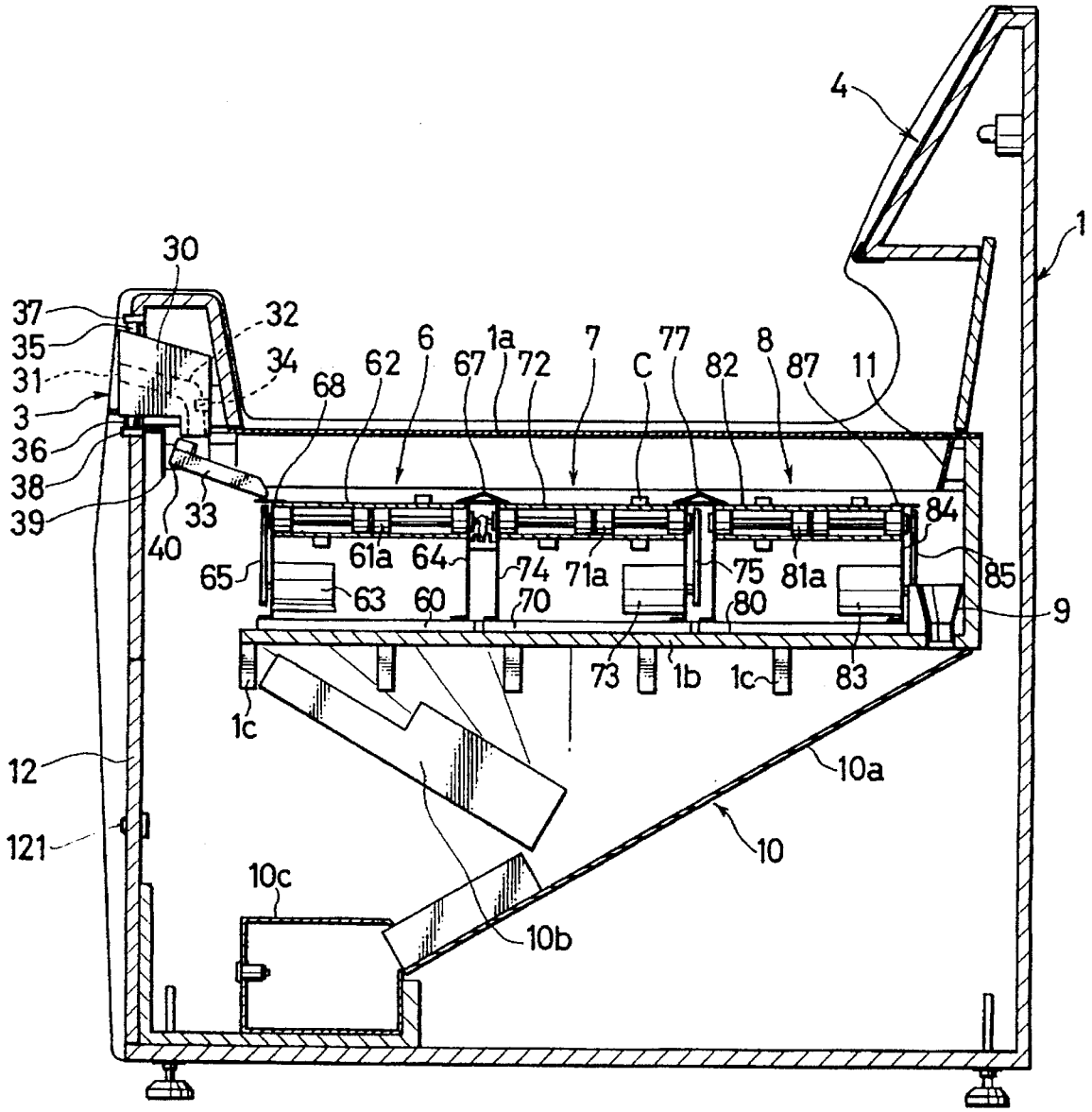
FIG. 2 is a view in a vertical section of the rolling game machine showing the internal construction of the rolling game machine.

Referring now to FIGS. 1 and 2, a coin recovery unit 10 is provided in a lower inner space of the housing 1 to collect coins passed through the pockets 9. The coin recovery unit 10 includes an inclined bottom plate member 10*a* and two front side trough members 10*b* attached on the upper inner surfaces of the left and right side walls of the housing 1. The right and left side edges are in close contact with the inner surfaces of the right and left side walls of the housing 1. A collecting portion is formed at a front end of the bottom plate member 10*a*. A terminal end of the collecting portion leads to a storage box 10*c*. In this way, coins passed through the reception pockets 9 are collected by the recovery unit 10 in the storage box 10*c*.

The front wall of the housing 1 is formed with an opening for withdrawing the storage box 10*c*. The opening is closed with an openable door 12 which is fastened to the housing 1 by a lock 121. When the storage box 10*c* is withdrawn, the lock 121 is released and the door 12 is opened.

Figure 12:
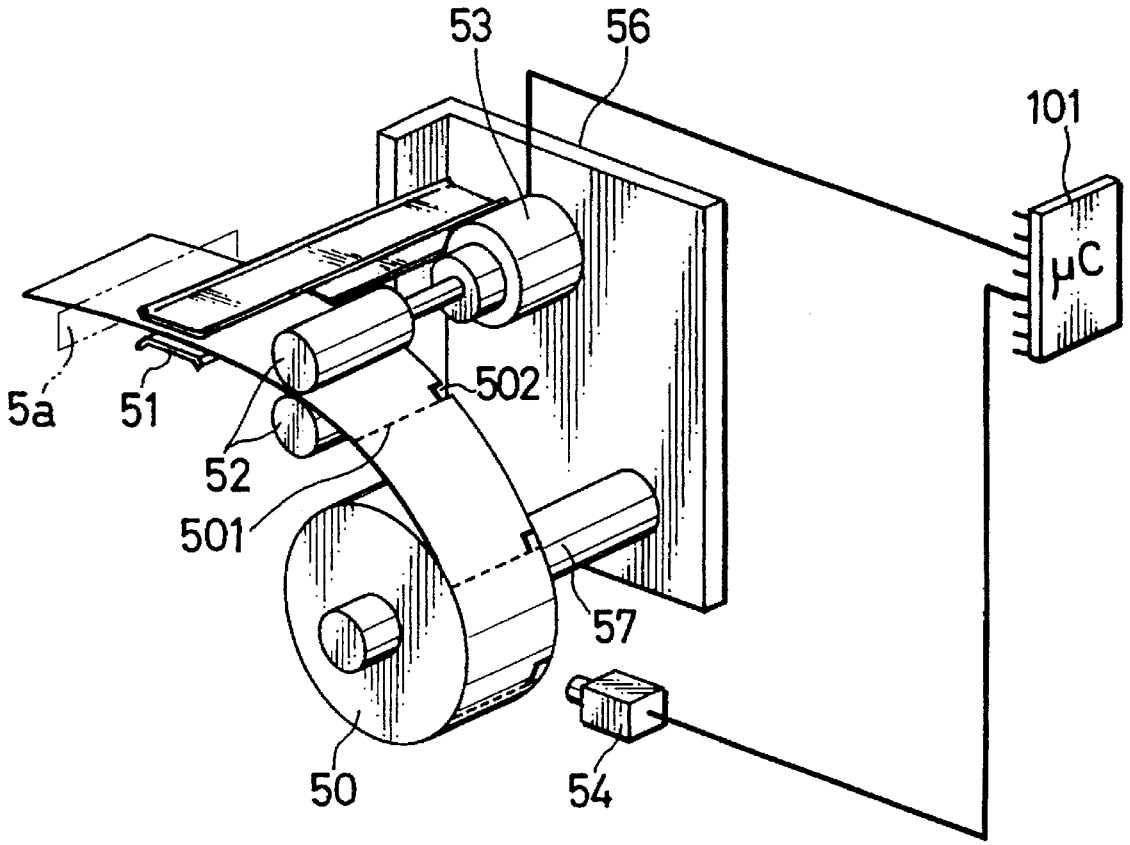
FIG. 12 is a perspective view showing a prize ticket issuing device provided in the rolling game machine.

Next, the prize ticket issuing device 5 will be described with reference to FIG. 12. The prize ticket issuing device 5 issues tickets corresponding to the score attained. The device 5 is provided on an inner surface of the front wall of the housing 1.

The device 5 includes a support plate 56 attached on the inner surface of the front wall of the housing 1, a supporting shaft 57 attached to the support plate 56, a rolled ticket tape 50 mounted on the supporting shaft 57, guide plates 51 attached to the support plate 56 for guiding the issued ticket to an outlet window 5*a* formed at a lower portion of the front wall of the housing 1, a pair of feeding rollers 52 provided upstream of the guide member 51 for feeding the ticket tape 50 forward, and a motor 53 supported on the support plate 56 for driving the feeding rollers 52.

The ticket tape 50 is provided with a number of sections having the same length. Each section is printed with a particular figure or character. Also, perforations 501 are provided between two adjacent sections to facilitate the cut off. Further, each section is formed with a recess 502 which is to be detected by a sensor 54.

The sensor 54 is provided for detecting the recess 502 formed in each section of the ticket tape 50. The sensor 54 is communicated with a microcomputer 101 which in turn counts the number of issued tickets based on a detection signal from the sensor 54. Also, the microcomputer 101 is communicated with the motor 53, and controls the motor 53 to feed out the ticket tape 50 by an amount corresponding to the attained score from the outlet window 5*a*.

It may be appreciated to provide a magnetic mark on each section instead of the recess 52, and a sensor capable of detecting the magnetic mark instead of the sensor 54.

Figure 13:
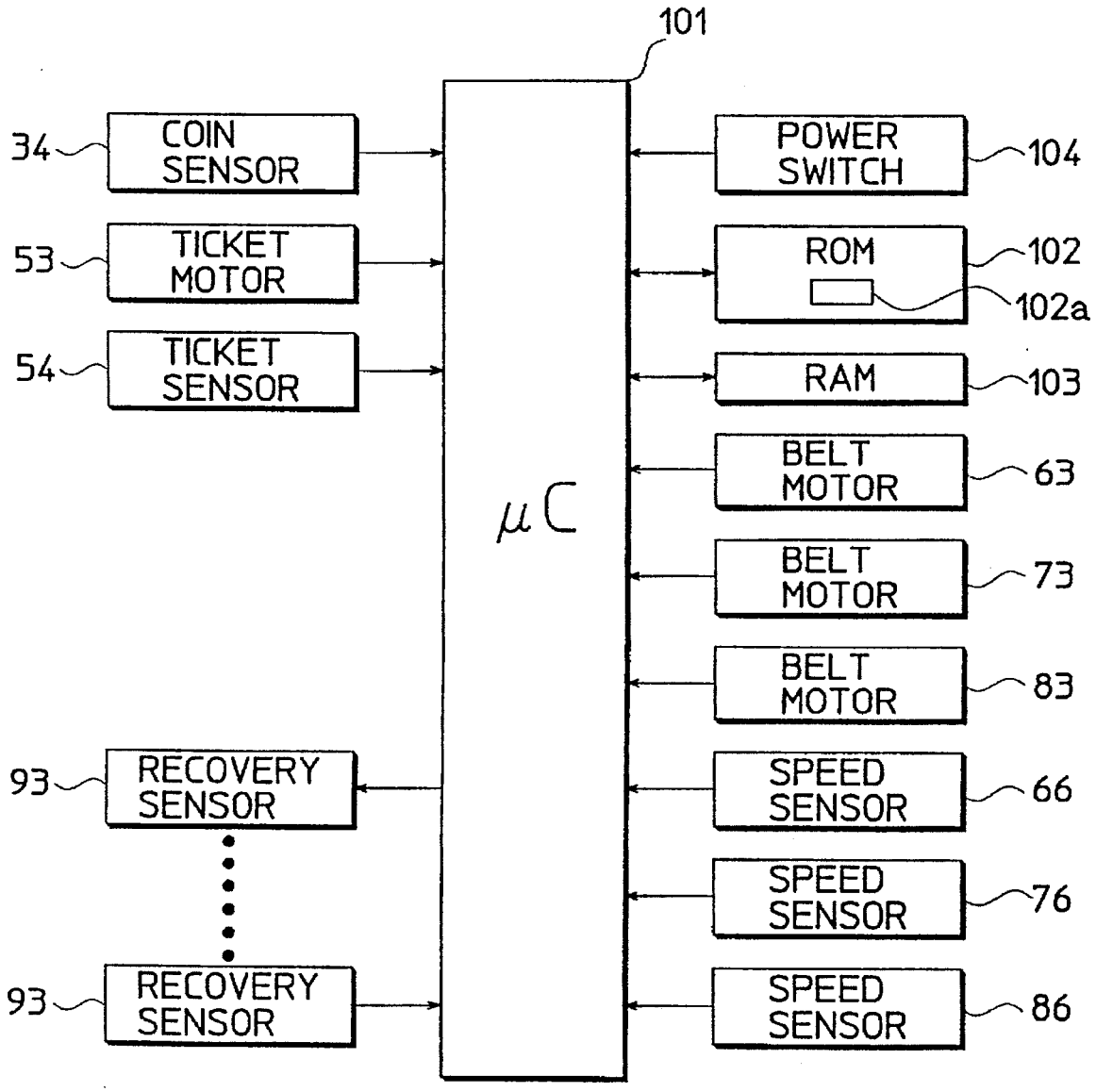
FIG. 13 is a block diagram showing a control system of the rolling game machine.

FIG. 13 is a block diagram showing a control system of the game machine. The microcomputer 101 is adapted for centrally controlling all the operations of the game machine, and is communicated with a Read Only Memory (ROM) 102 for storing a game program, a Random Access Memory (RAM) 103 for temporarily storing detection data obtained by the sensors, a power switch 104, the coin insertion sensor 34, the coin recovery sensors 93, the belt motors 63 to 83, the rotational speed sensors 66 to 86 as well as the ticket motor 53 and the ticket sensor 54. The ROM 102 has a portion 102*a* for storing a table relating the relationship between each coin recovery sensor 93 and a score.

Next, operations of the game machine will be described with reference to a flowchart shown FIG. 14.

Upon the power switch 104 is turned on, this flow is started. In Step S2, the belt motors are driven to move the interference endless belts in predetermined directions at predetermined speeds, respectively, thereby providing the game in an enabling state. In this state, the microcomputer 101 waits for the coin insertion. Specifically, it is judged in Step S4 whether the coin sensor 34 detects a coin.

After the coin is inserted (YES in Step S4), it is judged in Step S6 whether a coin recovery sensor 93 detects the coin. Further, in Step S8, it is judged which score pocket 9 the coin has fallen into.

It will be seen that there probably may be a great number of courses which an inserted coin can be expected to roll along. For example, there may be a case that an inserted coin successfully rolls across all the interference endless belts 62, 72, 82 and then falls into the highest score "125" pocket positioned at the rear center. Also, there may be a case that an inserted coin unfortunately collides with an interference car attached on the front interference endless belt 62, and is moved to the "OUT" pocket positioned at front side located closest to the front.

The judgment of receiving pocket 9 is executed on the basis of signals from the coin recovery sensors 93. After the receiving pocket 9 is judged, a score is determined for the receiving pocket 9 in accordance with the table stored in the portion 102*a* of the ROM 102 in Step S10.

Subsequently, the ticket motor 53 is driven to feed the ticket tape 50 forwardly from the outlet window 5*a* in Step S12. In the feeding of the ticket tape 50, the ticket sensor 54 sends a detection signal to the microcomputer 101 each time detecting a recess 502 formed in the ticket tape 50. The microcomputer 101 increments the number of issued tickets by detecting each signal in Step S14.

In Step S16, it is judged whether the number of issued tickets reaches a number corresponding to the determined score. When tickets are judged to be issued the number corresponding to the determined score (YES in Step S16), the ticket motor 53 is stopped in Step S18, and this flow returns to Step S4. The operations of Steps S4 to S18 are repeated until the power switch 104 is turned off.

Figure 14:
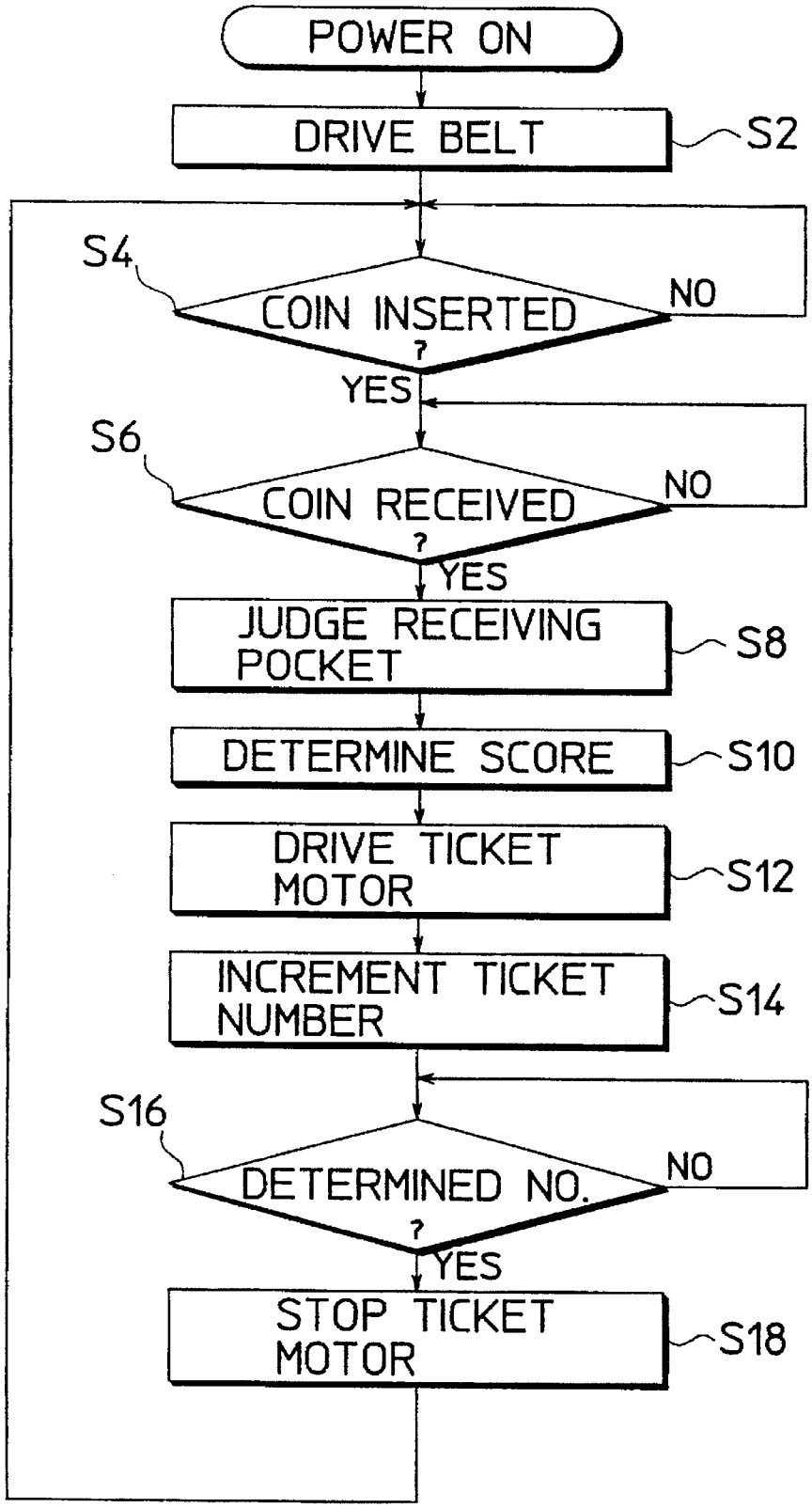
FIG. 14 is a flowchart showing operations of the rolling game machine.

In the control arrangement shown in FIG. 14, tickets are issued each time a coin is inserted and received by a pocket. According to the present invention, however, it may not be required to issue tickets each time a coin is inserted and detected by a coin recovery sensor 93, but it may be possible to issue tickets after a coin is detected by a coin recovery sensor 93 without executing the coin insertion judgment for each coin. This control manner makes it possible to issue tickets each time a coin passes a coin recovery pocket irrespective of the order of coin insertion. In other words, even if several coins are continuously inserted at short intervals, some coins roll in the playing portion at the same time, and coins do not fall into recovery pockets in the order of insertion, tickets can still be accurately issued each time a coin falls into a recovery pocket.

In the foregoing embodiment, the three endless belts 62, 72, 82 are provided in the interference zone. However, it may be possible to provide only one endless belt in the interference zone. Also, it may be possible to provide two, four or more belts in the interference zone, and further to move a plurality of belts in the same direction or in opposite directions.

The moving surface of the interference zone is not required to be moved at a constant speed. It may be possible to allow the player to select a desired moving speed. Also, it may be possible to programmedly change the moving speed during the time of coin rolling to raise the amusement level of the game.

It may be possible to move narrow plates in widthwise directions instead of the endless belts.

In place of the miniature cars C, also, it may be possible to attach miniature animals, e.g, brutal animals. Further, it should be noted that the game of the present invention can be sufficiently accomplished merely by rolling a coin across a horizontally moving surface, accordingly, it is not absolutely required to attach interference objects such as cars to a moving surface.

In the foregoing embodiment, prize tickets are issued a number corresponding to an attained score. However, it may be possible to display an attained score at an appropriate portion of the machine instead of issuing prize tickets.

The foregoing embodiment adopts a situation where a coin rolls over a traffic road having three lanes. According to the present invention, however, it may be possible to provide other situations. For example, a situation of soccer game may be adopted as shown in FIG. 15.

Figure 15:
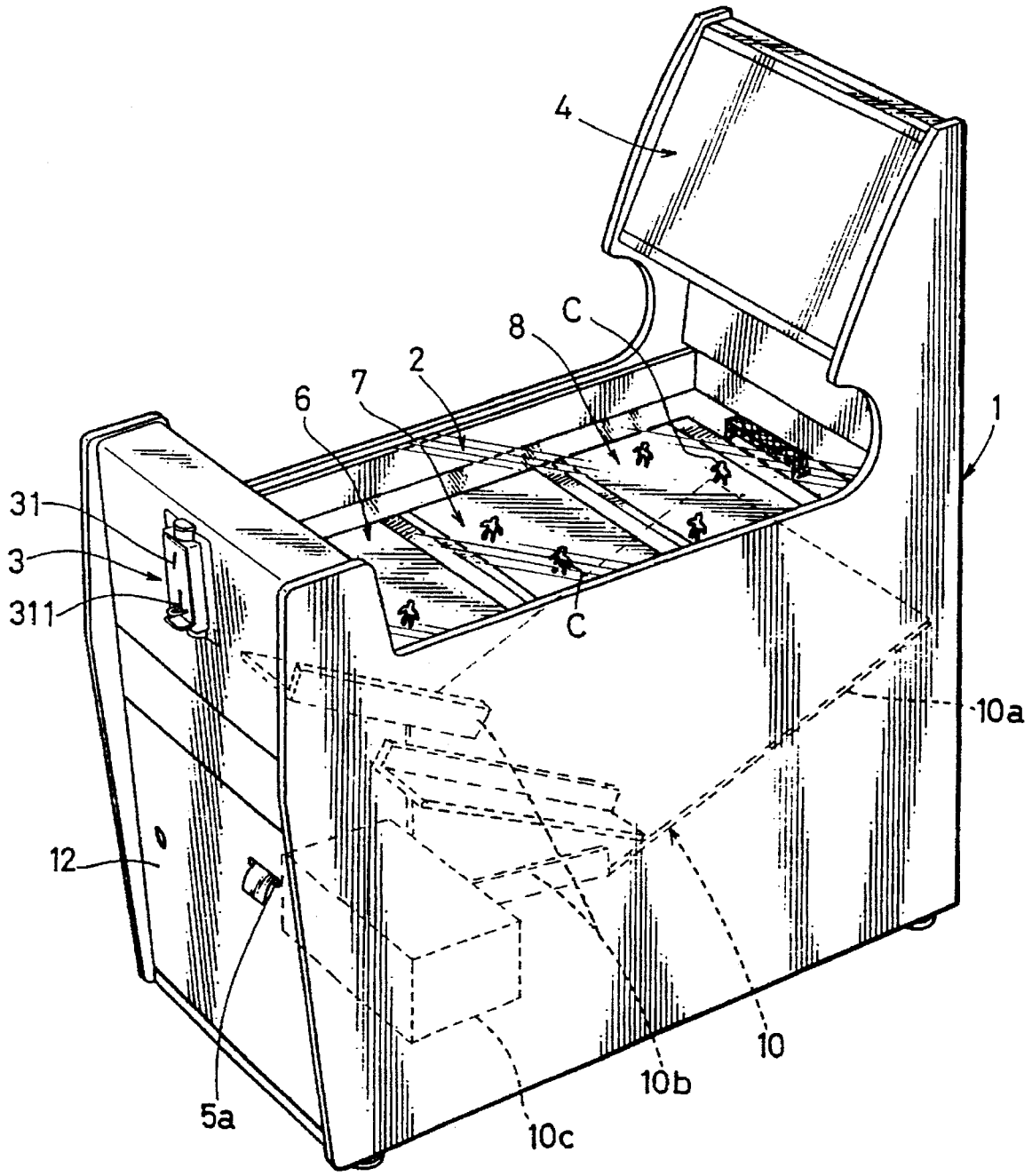
FIG. 15 is a perspective view showing another rolling game machine of the present invention.

The rolling game machine shown in FIG. 15 has basically the same construction as the foregoing game machine except for the following. Accordingly, like parts are indicated by like numerals.

In this game machine, interference belts 62, 72, and 82 are imitatively drawn with a soccer field. A rolling unit 3 is formed with a round opening. Forward players are disposed on a front interference belt 62, midfield players on an intermediate interference belt 72, and defense players and a goal keeper on a rear interference belt 82. A score indicating member 11 displays a score for goals only. A round ball is inserted into the round opening of the rolling unit 3 in an attempt to roll in the goal disposed at the rear position while escaping players moving in a widthwise directions.

Further, it may be possible to use oval balls or other like as rolling object other than a coin for the traffic game and a round ball for the soccer game.

Although the present invention has been fully described by way of example with reference to the drawings, it is to be understood that various changes and modifications will be apparent to those skilled in the art. Therefore, unless otherwise such changes and modifications depart from the scope of the invention, they should be construed as being included therein.

What is claimed is:

1. A rolling game machine for use by a player comprising:

a housing having a front end, a rear end, and opposite sides;

a rolling unit which is provided in the front end and by way of which the player rolls a rollable object toward the rear end; and an interference means movable in a sidewise direction between said opposite sides of said housing and intersecting a depthwise direction extending from the front end to the rear end of said housing to give the object rolling from the front end toward the rear end a force having a vector parallel to said sidewise direction to thereby interfere with the advance of the rolling object toward the rear end, said interference means being operable to carry to at least one of said opposite sides of said housing objects which have been stopped by said interference means on the way to the rear end of said housing.

2. A rolling game machine as defined in claim 1, further comprising an end detector arranged at said rear end of said housing for detecting a rollable object which has reached said rear end of said housing.

3. A rolling game machine as defined in claim 2, further comprising an opposite detector arranged at said at least one opposite side of said housing for detecting a rollable object which has fallen and moved by the interference means to said at least one opposite side of said housing.

4. A rolling game machine as defined in claim 3, further comprising an end reception pocket provided at said rear end of said housing for receiving a rollable object which has rolled across said interference means, said end reception pocket carrying said end detector; and an opposite reception pocket provided at said at least one opposite side of said housing for receiving a rollable object which has fallen and moved by the interference means, said opposite reception pocket carrying said opposite detector.

5. A rolling game machine as defined in claim 4, wherein each of the opposite detector and the end detector includes a photosensor having an optical path intersecting a passing path of the rollable object.

6. A rolling game machine as defined in claim 5, wherein the photosensor includes:

a first set of a light emitter and a light receiver facing each other; and a second set of a light emitter and a light receiver facing each other and arranged on a line intersecting a line along which the first set is arranged.

7. A rolling game machine as defined in claim 3, further comprising a rating device which assigns a rate to a rollable object which has completed its rolling on the basis of detection by said end detectors and said opposite detectors.

8. A rolling game machine as defined in claim 7, further comprising a ticket issuing device which issues a ticket corresponding to said assigned rate.

9. A rolling game machine as defined in claim 7, wherein the rating device includes a memory storing a relationship between said assigned rates and the end detectors and the opposite detectors.

10. A rolling game machine as defined in claim 1, wherein said interference means includes a plurality of endless belts moveable in said sidewise direction and arranged in parallel with one another in said depthwise direction.

11. A rolling game machine as defined in claim 10, further comprising an end detector arranged at said rear end of said housing for detecting a rollable object which has rolled across the plurality of endless belts.

12. A rolling game machine as defined in claim 11, further comprising a plurality of opposite detectors arranged at said at least one of said opposite sides of said housing for detecting a rollable object which has fallen and which has been moved by said endless belts to said at least one opposite side of said housing.

13. A rolling game machine as defined in claim 12, further comprising a rating device which assigns a rate to a rollable object which has completed its rolling on the basis of detection by said opposite detectors and said end detectors.

14. A rolling game machine as defined in claim 10, wherein at least one of the plurality of endless belts is movable in a direction opposite to the moving direction of at least one other endless belt.

15. A rolling game machine as defined in claim 10, further comprising interference objects attached to said plurality of endless belts.

16. A rolling game machine as defined in claim 10, further comprising a bridging member provided between adjacent endless belts of said plurality of endless belts, said bridging member extending in said sidewise direction for enabling a rollable object to roll from one endless belt to the next endless belt.

17. A rolling game machine as defined in claim 16, wherein the bridging member is formed with a rising surface.

18. A rolling game machine as defined in claim 1, wherein said interference means defines a planar surface on which said rollable objects roll, and pivotal means pivotably mounting said rolling unit about an axis intersecting a plane parallel with said planar surface of said interference means so that the player selectively determines the rolling direction of said rollable object.

19. A rolling game machine as defined in claim 1, wherein the rollable object is a coin.

20. A rolling game machine for use by a player comprising:

a housing having a front end, a rear end, and opposite sides, said housing having a depthwise direction extending between said front end and said rear end and a sidewise direction extending between said opposite sides;

a rolling means on said front end operable to enable a player to commence the rolling of a rollable object toward said rear end;

interference means moveable in a sidewise direction which intersects said depthwise direction and operable to impart a sidewise movement to said object; and receiving means along at least one of said opposite sides of said housing, said interference means being operable to move those rotatable objects which have stopped rolling before reaching the rear end of said housing to said receiving means along said at least one side of said housing.

21. A rolling game machine according to claim 20 wherein at least one of said sides of said housing has a plurality of indicia of varying magnitude, said receiving means including detecting means providing different detection signals corresponding to the magnitude of said varying indicia.

22. A rolling game machine according to claim 21 wherein said varying indicia progressively varies as said front end of said housing is approached.

23. A rolling game machine according to claim 21 wherein said receiving means comprising a plurality of receiving chutes corresponding in number to the number of the magnitude of said varying indicia such that a receiving chute is thereby provided for each magnitude of said varying indicia, said receiving chutes receiving said rollable objects which have been moved to said at least one side of said housing by said interference means.

24. A rolling game machine according to claim 23 wherein each of said receiving chutes includes one of said detecting means for detecting rollable objects which are received in the receiving chute in which the detecting means is included.

25. A rolling game machine according to claim 20 wherein said receiving means are provided at each opposite side of said housing.

26. A rolling game machine according to claim 20 wherein said interference means comprises a plurality of moveable belts with one belt being moveable in one sidewise direction from one side of said housing to another opposite side of said housing and another belt is moveable in an opposite sidewise direction from said other side of said housing to the said one side of said housing, said receiving means being disposed at said one side and at said other side of said housing.

27. A rolling game machine according to claim 20 wherein at least one of said sides of said housing has a plurality of indicia of varying magnitude, said receiving means including detecting means providing different detection signals corresponding to the varying magnitude of said indicia.

28. A rolling game machine for use by a player comprising a housing having a front end, a rear end, and opposite sides, said housing having a depthwise direction extending between said front end and said rear end and a sidewise direction extending between said opposite sides;

a rolling means on said front end operable to enable a player to commence the rolling of a rollable object toward said rear end;

interference means moveable in a sidewise direction which intersects said depthwise direction and operable to impart a sidewise movement to said object; and detecting means along at least one of said opposite sides of said housing, said interference means being operable to move those rollable objects which have stopped rolling before reaching the rear end of said housing to said detecting means along said at least one side of said housing such that said detecting means detects the amount of forward movement of said rollable object from said rolling means to the position where the objects have stopped rolling.

29. A rolling game machine for use by a player comprising:

a housing having a front end, a rear end, and opposite sides, said housing having a depthwise direction extending between said front end and said rear end and a sidewise direction extending between said opposite sides;

a rolling means on said front end operable to enable a player to commence the rolling of a rollable object toward said rear end;

interference means moveable in a sidewise direction which intersects said depthwise direction and operable to impart a sidewise movement to said object; and indicia means along at least one of said opposite sides of said housing, said interference means being operable to move those rotatable objects which have stopped rolling before reaching the rear end of said housing to said indicia means along said at least one side of said housing such that said indicia means indicate the amount of forward movement of said rollable object from said rolling means to the position where the objects stopped rolling.

* * * * *